US006695078B2

(12) United States Patent
Kim et al.

(10) Patent No.: US 6,695,078 B2
(45) Date of Patent: Feb. 24, 2004

(54) LARGE DIAMETER SAMPLER FOR GATHERING AN UNDISTURBED SAMPLE

(75) Inventors: Young-Chin Kim, Gwanjin-Gu (KR); Sung-Wan Hong, Gangnam-Gui (KR); Hyun-Min Kim, Nam-Gu (KR)

(73) Assignee: Korea Institute of Construction Technology (KR)

( * ) Notice: Subject to any disclaimer, the term of this patent is extended or adjusted under 35 U.S.C. 154(b) by 29 days.

(21) Appl. No.: 09/859,127

(22) Filed: May 16, 2001

(65) Prior Publication Data

US 2001/0042641 A1 Nov. 22, 2001

(30) Foreign Application Priority Data

May 16, 2000 (KR) ..... 2000-26030

(51) Int. Cl.[7] ..... E21B 25/10
(52) U.S. Cl. ..... 175/251; 175/20; 175/248
(58) Field of Search ..... 175/249, 248, 175/251, 274, 281, 20

(56) References Cited

U.S. PATENT DOCUMENTS 3,874,465 A * 4/1975 Young et al. ..... 175/20
4,296,822 A * 10/1981 Ormsby ..... 175/249
4,552,229 A * 11/1985 Radford et al. ..... 175/240
4,607,710 A * 8/1986 Radford ..... 175/249
4,930,587 A * 6/1990 Young et al. ..... 175/251

* cited by examiner

*Primary Examiner*—David Bagnell
*Assistant Examiner*—Zakiya Walker
(74) *Attorney, Agent, or Firm*—Harness, Dickey & Pierce, P.L.C.

(57) ABSTRACT

A cutting apparatus for use in a sampler is disclosed. The cutting apparatus includes an extension tube having a round unit on a bottom side of the extension tube; a cutting ring located in a bottom portion of a protecting tube; a guide tube which is internally equipped within the cutting ring; a plurality of cutters equipped to an outside of the cutting ring for closing a bottom portion of the sampling tube when the cutting ring is pulled by uplifting an up-lifting rod of the sampler, wherein a plurality of the cutters are uplifted followed by the guide tube and bended according the round unit in order to be gathered and closed; and a connection means for fixing a plurality of the cutters on the cutting ring. A sampler having the cutting apparatus can gather a sample of un-cohesive soil such as a sandy soil without spilling.

2 Claims, 8 Drawing Sheets

LARGE DIAMETER SAMPLER FOR GATHERING AN UNDISTURBED SAMPLE

FIELD OF THE INVENTION

The present invention relates to a large diameter sampler. More particularly, the present invention relates to a large diameter sampler capable of gathering an undisturbed sample in a cohesive soil or a sandy soil for examining a subsoil, a soil, a groundwater level, an internal force of a ground and a barrier situation within a plateau.

DESCRIPTION OF THE PRIOR ART

Due to rapid expansion of industry and development, civil engineering, construction, and building of facilities typically cannot be carried out on a favorably conditioned site.

That is, construction occurs in typically unfavorable places, such as a seaside, a mountainous area, and sanitary landfills, which have typically been excluded in past Ground information and analysis through accurate ground investigation is required to ensure safe and economical designs, execution of a structure, and for repairing and maintaining of an established structure.

The ground investigation is aimed at providing basic materials, such as ground characteristics, soil conditions, and an amount of ground settlement calculation.

When designing a structure, it is important to regulate ground settlement caused by a structural load within a permitted level, whereby the load given to a foundation may not exceed the allowable bearing capacity. Therefore, all information which may affect structural safety and calculation of ground settlement may be acquired through a ground investigation.

Preferably, ground investigation is carried out delicately, before construction to determine structural requirements, foundation requirements, suitable construction methods, and suitable building materials. If the ground investigation is delayed, a fixed construction period may prevent delicate investigation of the ground, thereby making it difficult to find an economical solution.

Ground investigation typically costs about 1~2% of the total cost of construction, however, significant cost can be avoided if prevention of damage to the construction as a whole is prevented.

In advanced countries, a good deal of investment and research is being performed to invent a sampler which gathers an undisturbed sample in a soft foundation without changing soil parameters. Research results indicate that a sample gathered by a large diameter LAVAL sampler made by LAVAL University, in Canada, has little disturbance when compared to that of a Japanese sample gathered by a piston sampler.

However, in a domestic soft foundation site, a water pressure piston sampler is typically used to gather an undisturbed sample while a sandy soil is typically not gathered yet.

SUMMARY OF THE INVENTION

It is, therefore, an object of the present invention to provide a large diameter sampler capable of gathering an undisturbed sample in both a cohesive soil as well as a sandy soil for more accurately acquiring a soil parameter which is needed for the foundation design of a structure.

Another object of the present invention is to provide a large diameter sampler capable of gathering an undisturbed sample while lifting an un-cohesive sample up to the ground without spilling by equipping a cutter with both a cutting function and a sample spilling interception function within a sampling tube.

In accordance with an aspect of the present invention, a large diameter sampler is provided for gathering an undisturbed sample. The large diameter sampler includes an outer tube having a bit on a bottom portion thereof for excavating a ground, wherein the outer tube is rotated by applying an external power thereto for penetrating the tube into the ground. Additionally, a means for protecting a sample from a disturbance is provided and is generated by a rotating excavation of the bit, wherein the protecting means is located the bottom portion of the outer tube. The protecting means is disposed internally in the tube, and is penetrated into the ground by weight. A sampling tube for locating the sample pulled-out by weight of the protecting means, and a cutting means for sheltering a bottom portion of the sampling tube for protecting spilling of the gathered sample are also included, wherein the cutting means is equipped within the protecting means for cutting the sample pulled-out by the sample protecting means. Further, a means for lifting the sampling tube and the protecting means is provided, whereby the means of lifting is operable to apply a lifting force from an operating device which is located on the earth. In addition, an outer rod connects the outer tube and a boring device on the earth.

BRIEF DESCRIPTION OF THE DRAWINGS

Other objects and aspects of the invention will become apparent from the following description of the embodiments with reference to the accompanying drawings, in which.

DETAILED DESCRIPTION OF THE PREFERRED EMBODIMENTS

Hereinafter, a large diameter sampler according to the present invention will be described in detail referring to the accompanying drawings.

A large diameter sampler in accordance with the present invention is capable of gathering an undisturbed sample in a cohesive soil as well as a sandy soil.

Figure 1:
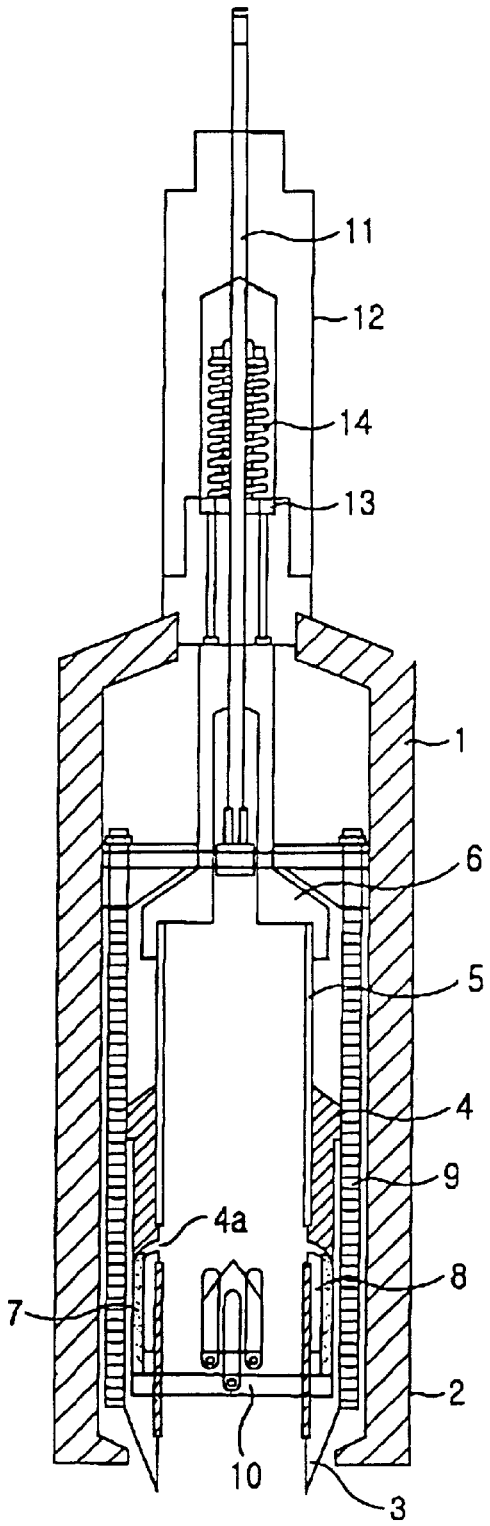
FIG. 1 is a cross-sectional view illustrating a large diameter sampler capable of gathering an undisturbed sample in accordance with the present invention.
Figure 2:
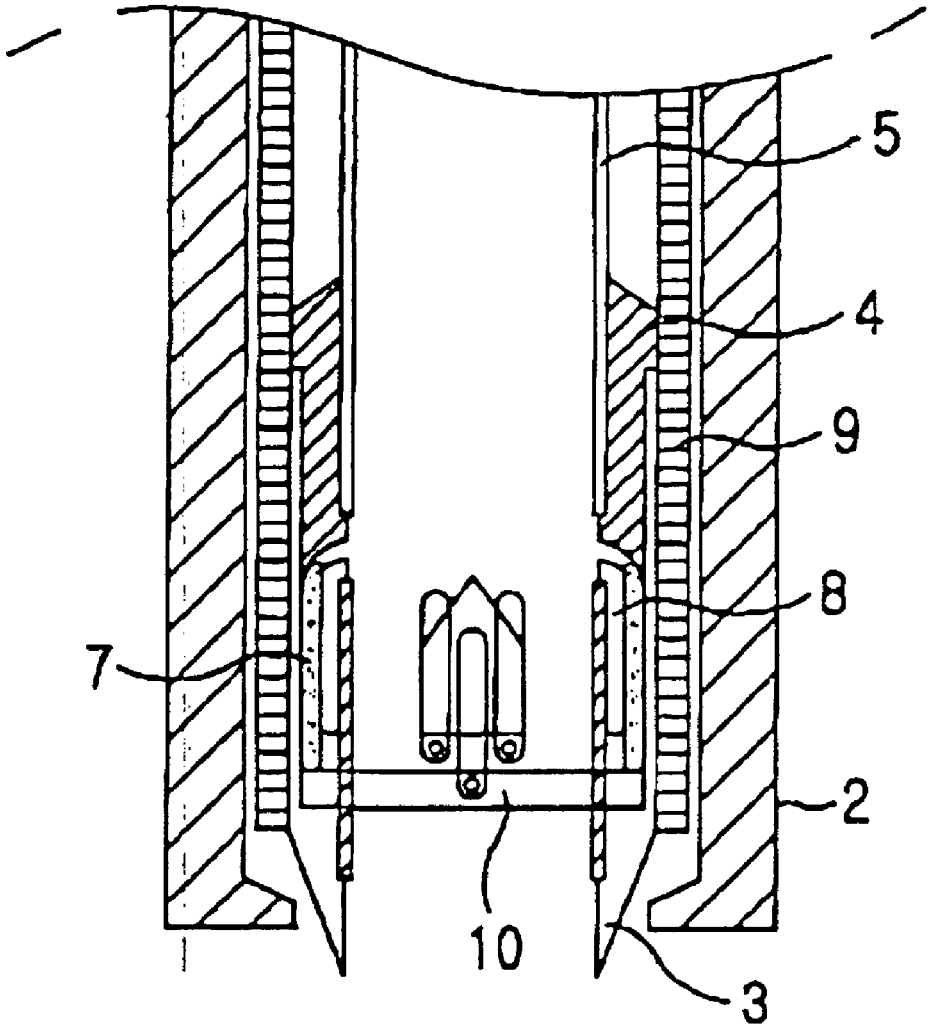
FIG. 2 is a cross-sectional view showing a cutting part configuration of a large diameter sampler in accordance with the present invention.
Figure 3:
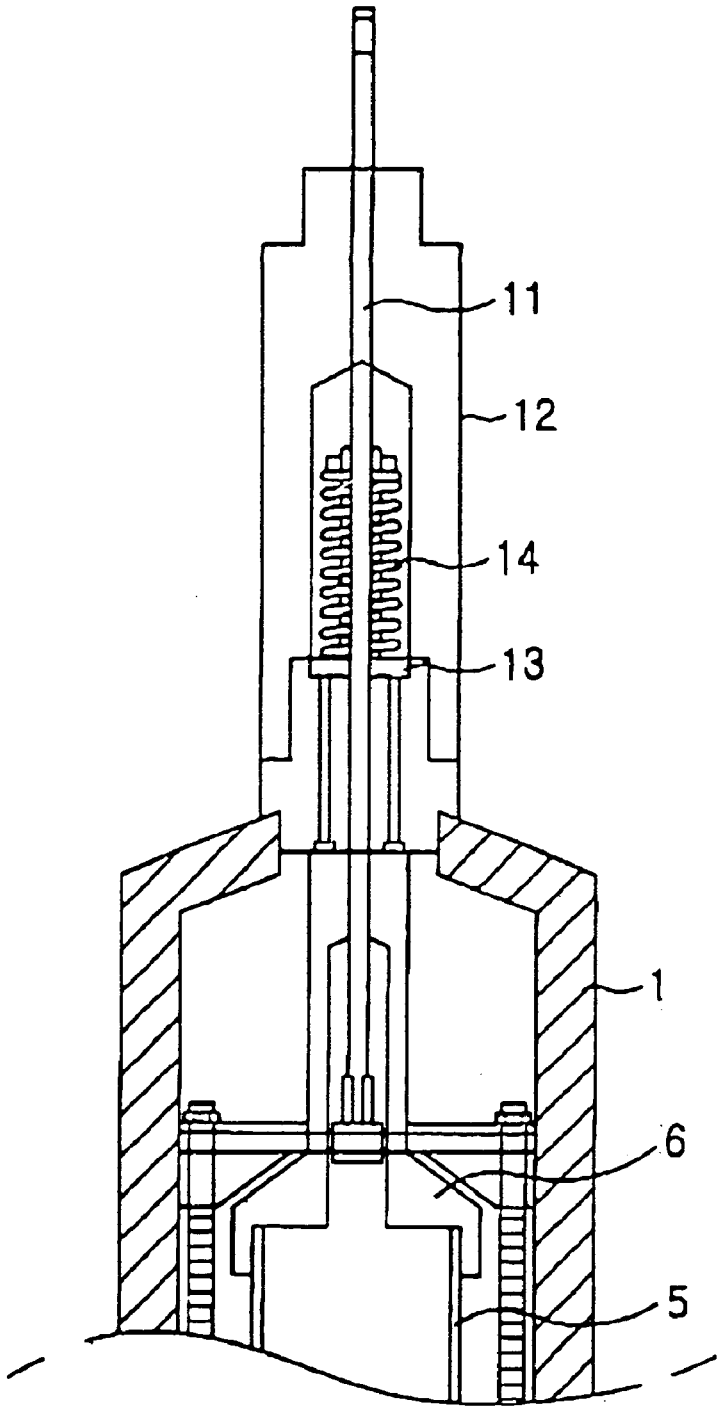
FIG. 3 is a cross-sectional view showing a head part configuration of a large diameter sampler in accordance with the present invention.

Referring to FIGS. 1 to 3, the sampler includes an outer tube 1, which provides a bit 2 in its bottom portion for excavating a ground, wherein the outer tube 1 rotates by applying an external power to the tube for penetrating into the ground. A shoe 3 protects a sample from a disturbance generated by a rotating excavation of the bit 2, wherein the shoe 3 is internally equipped to a bottom portion of the outer tube 1, and is penetrated into a ground by the overall weight of the sampler.

An extension tube 4 connects an inside portion of the shoe 3 and a sampling head, whereby the extension tube 4 is extracted by the penetration of the shoe 3. A sampling tube 5 is inserted within the extension tube 4 and stores the sample gathered by the shoe 3.

A sampling head 6 is attached to a top portion of the sampling tube 5 and serves to discharge any slime existing on the sample. A cutter 7 is equipped within the shoe 3 and cuts a sample pulled-out by its weight, thereby prohibiting an outputting of the gathered sample. A guide tube 8 is equipped within the cutter 7 and prohibits disturbance of the gathered sample caused by the cutter 7. A cutting rod 9 is vertically equipped outside of the shoe 3 and translates within the outer tube 1 in condition of internally fitting the shoe 3. A cutting ring 10 is equipped to a bottom portion of the shoe 3 and connects the cutting rod 9 and the cutter.

An inner rod 11 is inserted at a first end into the sampling head 6 and connects into an operating device on the ground at a second end.

An outer rod 12 connects the outer tube 1 and a boring device (not shown), while a bearing 13 is externally equipped to the inner rod 11, to smoothly rotate the outer tube 1 and prohibit rotation of the shoe 3 connected to the sampling tube 5.

A spring 14 regulates the sample gathered by the rotating excavation of the bit 2 through an elastic operation, whereby the elastic operation serves to maintain a relative gap between the bit 2 of the outer tube and the shoe 3 according to ground intensity.

Figure 4:
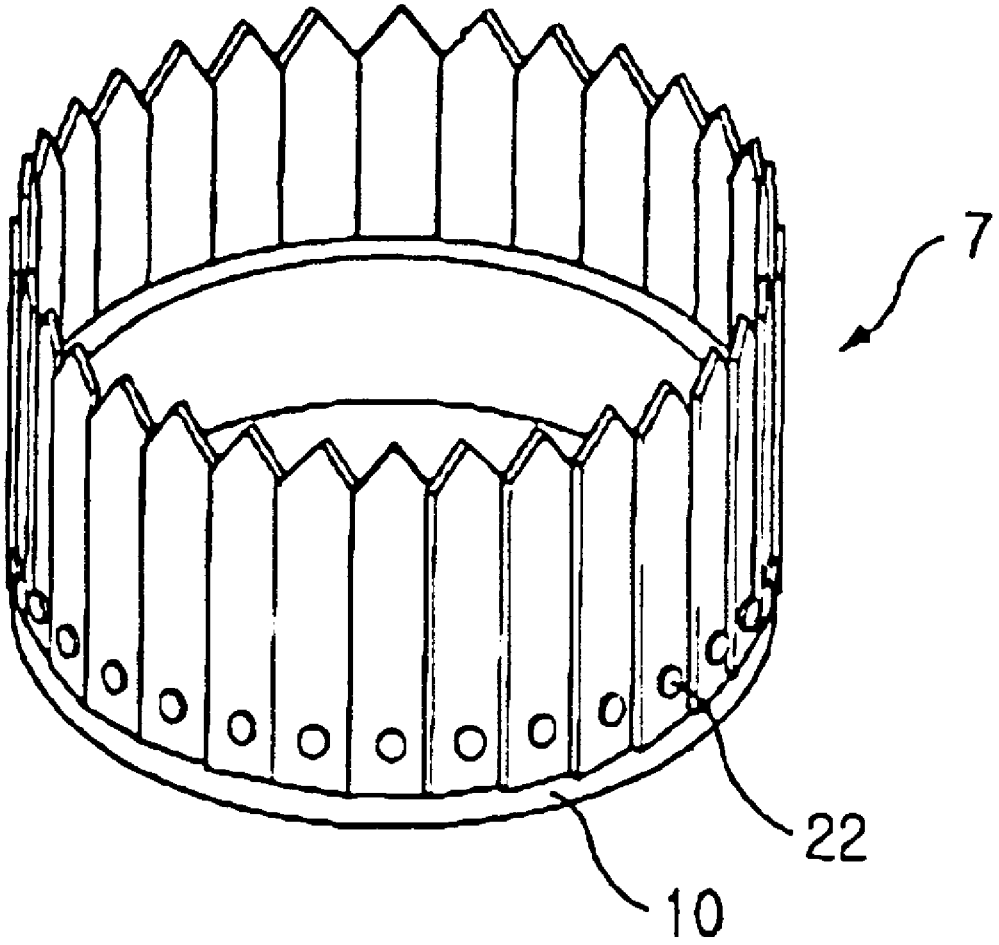
FIG. 4 is a perspective view showing a sectional configuration of a lumbar of a large diameter sampler in accordance with the present invention.

In here, the extension tube 4 has a round unit 4*a*. The round unit 4*a* is formed at a bottom of the extension tube 4 and a bottom of the round unit 4*a* is rounded for guiding a plurality of the cutters 7 to be folded as like as a camera shutter, to thereby closing a bottom of the sample tube 5. A top portion of each of a plurality of the cutters 21 is formed in a pentagon shape as shown in FIG. 4 and equipped outside of the cutting ring 10 by folding in predetermined part, and a plurality of the cutters 7 and the cutting ring 10 are fixed with a connection part 22, such as a bolt.

Figure 5A:
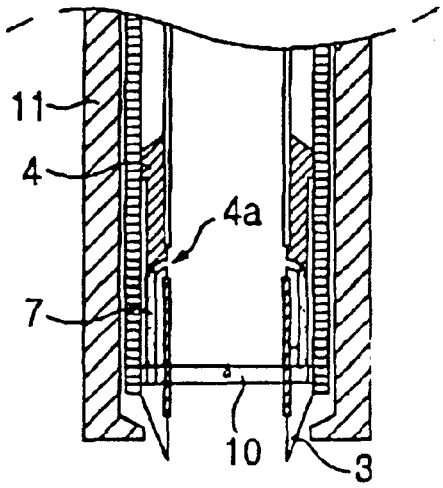
FIGS. 5A to 5E are situational views showing a cutting part configuration in accordance with the present invention.
Figure 5B:
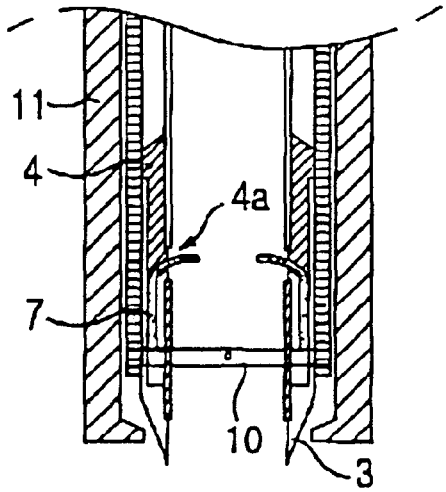
Figure 5C:
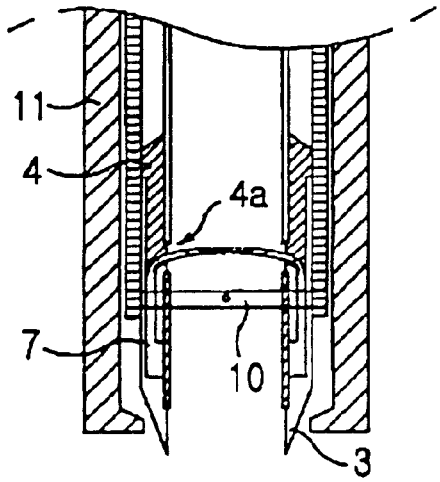
Figure 5D:
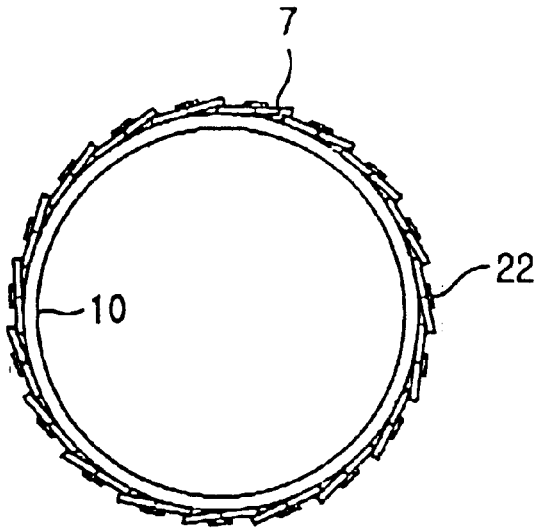
Figure 5E:
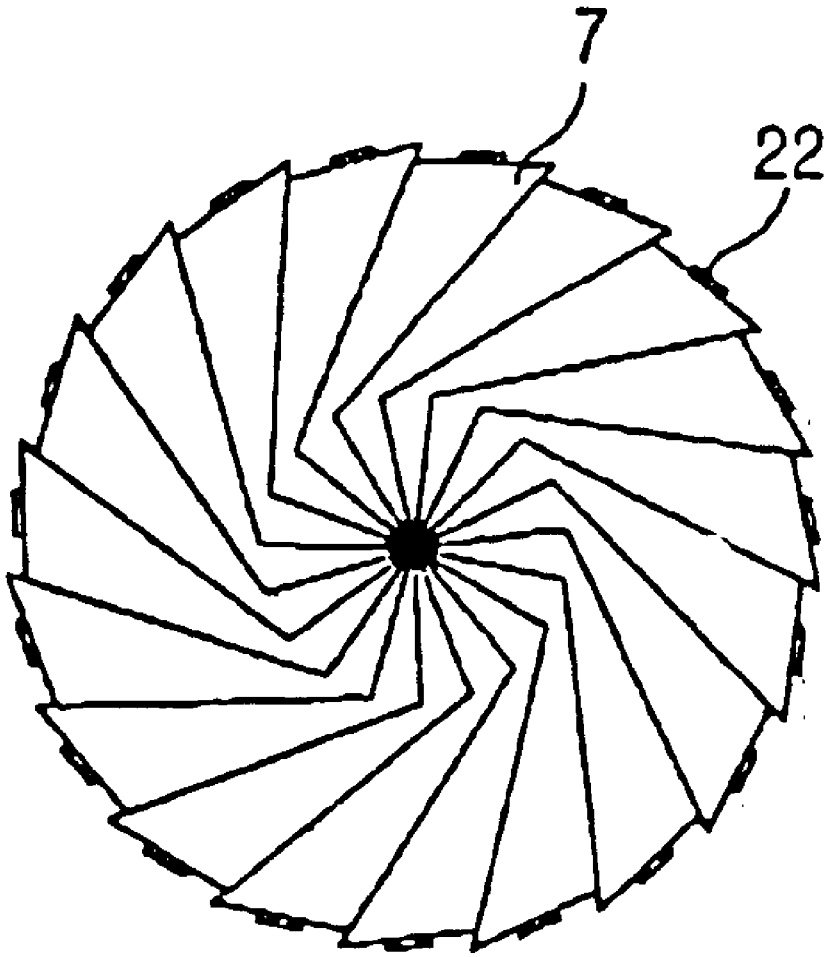

As shown in FIG. 5A, the cutter 7 is located between the guide tube 8 and the extension tube 4 by fixing the cutting ring 10. When the inner rod 11 is pulled by the ground as shown in FIGS. 5B and 5C, a plurality of the cutters 7 is drawn out toward to inside of the sampling tube 5 by the round unit 4*a* of the extension rube 4 to thereby folded each other and closed in the form of camera dosing, as shown in FIGS. 5D and 5E.

Figure 6A:
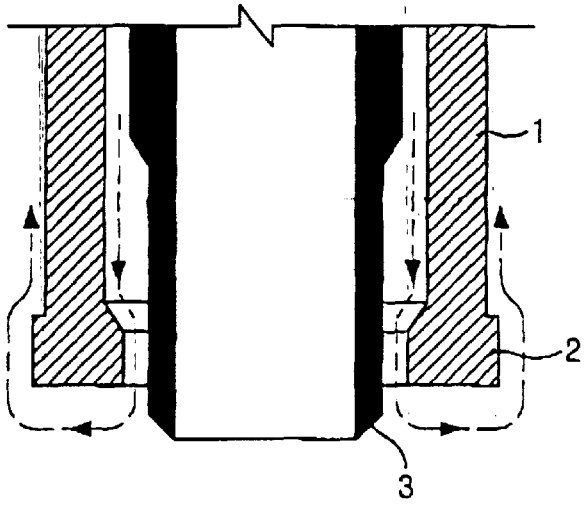
FIGS. 6A and 6B are cross-sectional views showing ground excavation between a bit and a shoe in condition to the ground protecting a sample from a disturbance generated by the excavation in accordance with the present invention.
Figure 6B:
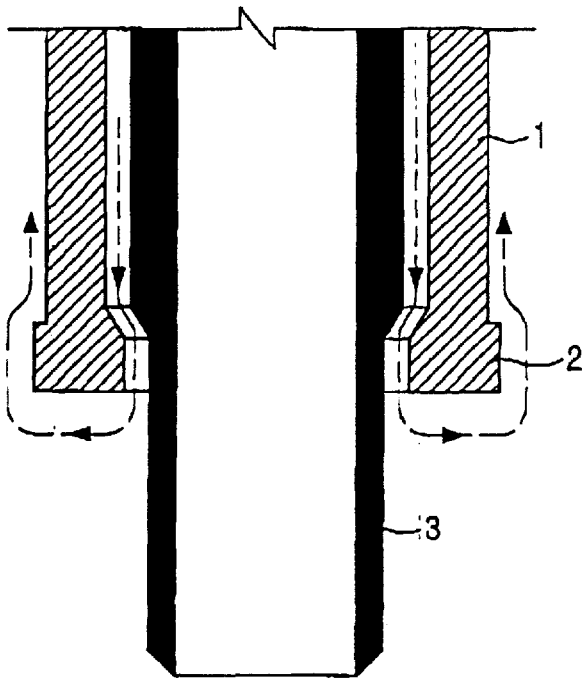

As shown in FIGS. 6A and 6B, the shoe 3 is projected at a predetermined length from an end edge of the bit 2. The length difference gives a relative interval between the bit 2 and the shoe 3 in excavation depending on the condition of the ground with relation to the spring 14 functions, as will be discussed further below.

That is, in a soft ground, by movement of the spring 14, the interval between the bit 2 and the shoe 3 is increased. Similarly, in a hard ground, such as bedrock, the interval between the bit 2 and the shoe 3 is decreased due to the compression of the spring 14.

Likewise, a disturbance caused by the excavation of the bit 2 is intercepted by the shoe 3, to thereby protect the gathered sample.

With reference to the Figures, the operating process of the present invention will be described in detail.

As shown in the drawings, to gather an undisturbed sample of a cohesive soil or a sandy soil, the bit 2 of the outer tube 1 must first be equipped on the ground.

Subsequently, by applying a rotating power to the outer tube 1, the bit 2 will excavate and penetrate into the ground. At this time, the shoe 3, which extends farther than the edge of the bit 2 is penetrated into the ground by weight. The shoe 3 cuts off a disturbance soil generated by the penetrating of the bit 2, to thereby prohibit disturbance of the inserted sample.

When the shoe 3 has penetrated the ground, the sampling tube 5 has similarly penetrated the ground as well, through extraction of the extraction tube 4.

When the required samples are gathered into the sampling tube 5 the inner rod 11 is lifted. In this regard, the tip of the cutter 7, which is located in a hole between the extension tube 4 and the guide tube 8 is draws out along the hole to cut off the sample and close the bottom portion of the sampling tube 5. In this manner, the tip of the cutter 7 prevents spilling of the sample.

As above described, by gathering an undisturbed sample into the sampling tube 5, a soil parameter required in foundation design of a structure can be accurately obtained.

The soil parameter includes, unity of a cohesion, angle of internal friction, stiffness, compression index, and coefficient of consolidation Again, each of these factors is important in the design and construction of a foundation, a bridge, or a retaining wall.

As above described, when gathering a cohesive soil or a sandy soil, the large diameter sampler in accordance with the present invention protects the samples. The samples may be disturbed in the course of excavating, through use of a shoe. The sampler of the present invention provides a cutter which cuts off the sample and closes a bottom portion of a sampling tube, to thereby easily gather an undisturbed sample and accurately obtain a soil parameter needed in foundation design of a structure.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A cutting apparatus for use in a sampler, wherein the sampler has an outer tube with a bit for excavating a ground, a protecting tube for protecting a sample from a disturbance generated by a rotating excavation of the bit, a sampling tube for containing a sample and an up-lifting rod for up-lifting the sampling tube and the protecting tube, comprising:

an extension tube which is internally equipped within the protecting tube and having a round unit on a bottom side of the extension tube, which is rounded;

a cutting ring located in a bottom portion of the protecting tube in a cylindrical form;

a guide tube which is internally equipped within the cutting ring;

a plurality of cutters connected to an outside of the cutting ring within a predetermined interval for closing a bottom portion of the sampling tube when the cutting ring is pulled by uplifting the up-lifting rod of the sampler, wherein the plurality of the cutters are uplifted followed by the guide tube and bended according to the round unit in order to be gathered and closed; and a connection means for fixing a plurality of the cutters on the cutting ring.

2. The cutting apparatus of claim 1, wherein the cutter has a sharp end edge and is attached to the cutting ring by folding in a predetermined gap.

* * * * *